US011627818B2

(12) United States Patent
Hua et al.

(10) Patent No.: US 11,627,818 B2
(45) Date of Patent: Apr. 18, 2023

(54) DAMPER SYSTEM FOR PUSHER ASSEMBLY

(71) Applicant: Fasteners for Retail, Inc., Twinsburg, OH (US)

(72) Inventors: Yun Hua, Solon, OH (US); Shane Obitts, Elyria, OH (US)

(73) Assignee: Fasteners for Retail, Inc., Twinsburg, OH (US)

( * ) Notice: Subject to any disclaimer, the term of this patent is extended or adjusted under 35 U.S.C. 154(b) by 0 days.

(21) Appl. No.: 17/452,583

(22) Filed: Oct. 28, 2021

(65) Prior Publication Data

US 2022/0133060 A1 May 5, 2022

Related U.S. Application Data

(60) Provisional application No. 63/107,586, filed on Oct. 30, 2020.

(51) Int. Cl.
*A47F 1/12* (2006.01)

(52) U.S. Cl.
CPC ..... *A47F 1/126* (2013.01)

(58) Field of Classification Search
CPC ..... A47F 1/125; A47F 1/126
USPC ..... 211/59.3
See application file for complete search history.

(56) References Cited

U.S. PATENT DOCUMENTS 5,605,237 A * 2/1997 Richardson ..... A47F 1/126 211/59.3
6,464,089 B1 * 10/2002 Rankin, VI ..... A47F 1/126 211/59.3
6,691,891 B2 * 2/2004 Maldonado ..... A47F 1/125 211/59.3
6,820,754 B2 * 11/2004 Ondrasik ..... A47F 1/126 211/59.3
7,347,335 B2 * 3/2008 Rankin, VI ..... A47F 1/126 312/61
7,404,494 B2 * 7/2008 Hardy ..... B65G 27/12 211/59.3
7,533,784 B2 * 5/2009 Vlastakis ..... A47F 5/0861 221/153
7,628,282 B2 * 12/2009 Hardy ..... A47F 1/126 211/151
7,905,364 B2 * 3/2011 Pail ..... A47F 5/0869 211/59.3

(Continued)

FOREIGN PATENT DOCUMENTS

CN 105640161 A * 6/2016 ..... A47F 1/126
EP 3311706 A1 * 4/2018 ..... A47F 1/126

(Continued)

OTHER PUBLICATIONS

International Search Report and Written Opinion, related to Application No. PCT/US2021/072066, dated Apr. 19, 2022.

*Primary Examiner* — Jennifer E. Novosad
(74) *Attorney, Agent, or Firm* — Honigman LLP

(57) ABSTRACT

A dispensing system includes a track, a pusher, a biasing member, and a damper. The pusher is moveably coupled to the track. The biasing member is coupled to the pusher and the track and configured to move the pusher relative to the track in a first direction. The damper is coupled to the pusher and the track and configured to reduce a speed at which the pusher moves relative to the track in the first direction.

16 Claims, 5 Drawing Sheets

(56) References Cited

U.S. PATENT DOCUMENTS

| | | | | |
|---|---|---|---|---|
| 8,016,128 | B2 * | 9/2011 | Valiulis | A47F 1/126 211/59.3 |
| 8,190,289 | B2 * | 5/2012 | Lockwood | G07F 17/10 221/3 |
| 8,267,258 | B2 * | 9/2012 | Allwright | B65H 1/00 211/59.3 |
| 8,353,425 | B2 * | 1/2013 | Lockwood | G07F 9/002 221/227 |
| 8,646,650 | B2 * | 2/2014 | Lockwood | A47F 3/002 211/59.3 |
| 8,684,227 | B2 * | 4/2014 | Richardson | A47F 5/0823 70/57.1 |
| 9,119,488 | B2 * | 9/2015 | Lockwood | G07G 3/003 |
| 9,167,914 | B2 * | 10/2015 | Rankin, VI | A47F 11/10 |
| 9,265,362 | B2 * | 2/2016 | Hardy | A47F 1/125 |
| 10,111,540 | B2 * | 10/2018 | Brej | A47F 1/128 |
| 10,154,739 | B2 * | 12/2018 | Turner | A47F 1/125 |
| 10,172,482 | B2 * | 1/2019 | Pritchard | A47F 1/126 |
| 10,357,118 | B2 * | 7/2019 | Swafford | A47F 5/0068 |
| 10,993,550 | B2 * | 5/2021 | Ewing | H05K 7/1422 |
| 11,363,894 | B2 * | 6/2022 | Ewing | G08B 13/1436 |
| 2006/0163272 | A1 * | 7/2006 | Gamble | A47F 1/126 221/227 |
| 2006/0237381 | A1 * | 10/2006 | Lockwood | A47F 1/126 211/59.3 |
| 2007/0108142 | A1 * | 5/2007 | Medcalf | A47F 1/126 211/59.3 |
| 2009/0084812 | A1 * | 4/2009 | Kirschner | A47F 1/126 221/1 |
| 2022/0133060 | A1 * | 5/2022 | Hua | A47F 1/126 211/59.3 |

FOREIGN PATENT DOCUMENTS

| | | | | |
|---|---|---|---|---|
| WO | WO-2015003682 | A1 * | 1/2015 | A47F 1/126 |
| WO | WO-2022094568 | A1 * | 5/2022 | A47F 1/126 |

* cited by examiner

DAMPER SYSTEM FOR PUSHER ASSEMBLY

CROSS REFERENCE TO RELATED APPLICATIONS

This application claims priority under 35 U.S.C. § 119(e) to U.S. Provisional Application 63/107,586, filed on Oct. 30, 2020. The disclosures of this prior application is considered part of the disclosure of this application and is hereby incorporated by reference in its.

FIELD

The present disclosure relates to a dispensing system and more particularly to a dispensing system having a damper mechanism.

BACKGROUND

This section provides background information related to the present disclosure and is not necessarily prior art.

Shelving is used extensively for stocking and storing products or merchandise in a variety of stores. Such stores often use a forward feed device to control the storage and distribution of such products. In particular, the forward feed devices are used to automatically move merchandise forward on a shelf after an item is removed. In some instances, the forward feed device moves the merchandise forward at a speed that cause undesirable disruption to the merchandise remaining on the shelf. Accordingly, while known forward feed devices have proven useful for their intended purpose, a need for continuous improvement in the pertinent art remains.

SUMMARY

This section provides a general summary of the disclosure, and is not a comprehensive disclosure of its full scope or all of its features.

One aspect of the disclosure provides a dispensing system including a track, a pusher, a biasing member, and a damper. The pusher is moveably coupled to the track. The biasing member is coupled to the pusher and the track. The biasing member is configured to move the pusher relative to the track in a first direction. The damper is coupled to the pusher and the track. The damper is configured to reduce a speed at which the pusher moves relative to the track in the first direction.

Implementations of the disclosure may include one or more of the following optional features. In some implementations, the damper includes a rotary damper mechanism and a gear coupled to the rotary damper mechanism. The gear may include a first plurality of teeth configured to engage the track.

the track includes a second plurality of teeth intermeshed with the first plurality of teeth of the gear.

In some implementations, the pusher includes a first sidewall and a second sidewall opposing the first sidewall, the first sidewall and the second sidewall defining a void. The biasing member and the damper may be at least partially disposed within the void.

In some implementations, the damper includes a body and a shaft, the body coupled to the first sidewall, the shaft coupled to the rotary damper mechanism and the gear.

In some implementations, the pusher includes a base integrally formed with the first sidewall. The body of the damper may be at least partially disposed within the base.

In some implementations, a screw is coupled to the first sidewall and the body of the damper.

In some implementations, the pusher includes a plurality of legs secured to the track.

In some implementations, the track includes a first rail, a second rail, and an engagement mechanism disposed between the first rail and the second rail. The engagement mechanism may be configured to engage the damper.

In some implementations, the damper includes a gear having a first plurality of teeth, and the engagement mechanism includes a second plurality of teeth configured to engage the first plurality of teeth.

In some implementations, the dispensing system includes an adjustment mechanism configured to change a spring constant of the biasing member Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

Figure 1:
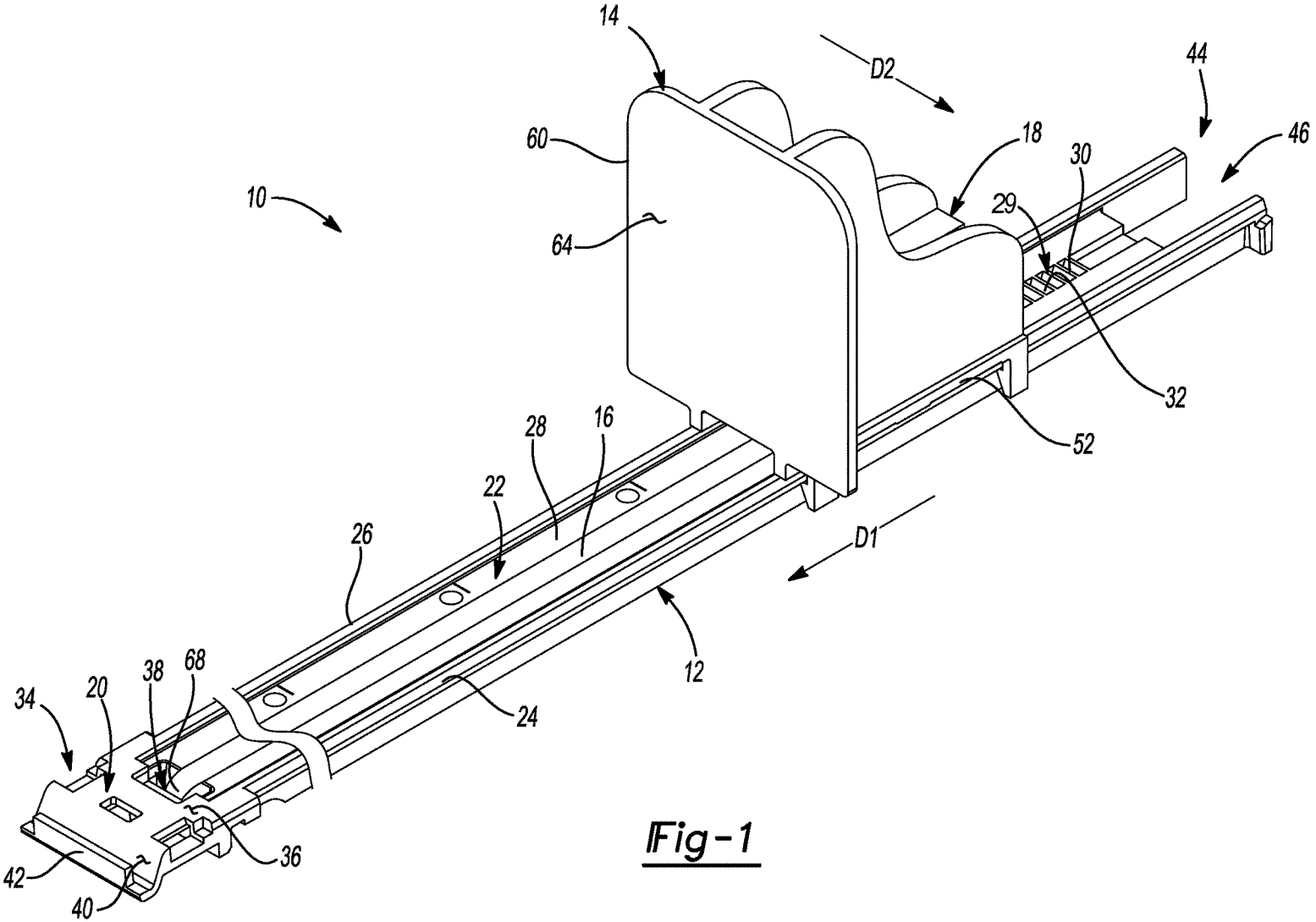
FIG. 1 is a front perspective view of a dispensing system in accordance with the principles of the present disclosure.

Referring to FIG. 1, a dispensing system 10 is illustrated. The dispensing system 10 may be disposed on a shelf (not shown) or other suitable supporting device. The dispensing system 10 may include a track 12, a pusher 14, a biasing member 16 (FIG. 2), and a damper system 18. The track 12 extends in a first direction D1 and may include a mounting head 20 and an elongated body 22 extending from the mounting head 20.

The elongated body 22 may include a pair of opposed rails 24, 26 extending parallel to each other and a first engagement mechanism 28 disposed between the pair of opposed rails 24, 26. In an assembled configuration, the track 12 may be coupled to a rail (not shown) disposed on the shelf or other suitable supporting device. Each of the rails 24, 26 extends continuously from the front end 34 of the track 12 to the rear end 44 of the track 12. In the illustrated example, each rail 24, 26 includes an outer flange 25 that projects outwardly from the respective rail 24, 26. Each flange 25 include an upper biasing surface 25*a* and a lower locking surface 25*b* formed on a bottom side of the flange 25. Here, the lower locking surface 25*b* extends outwardly from an outer side of the respective rail 24, 26 to define a channel 27 extending along the side of each rail 24, 26.

Figure 5:
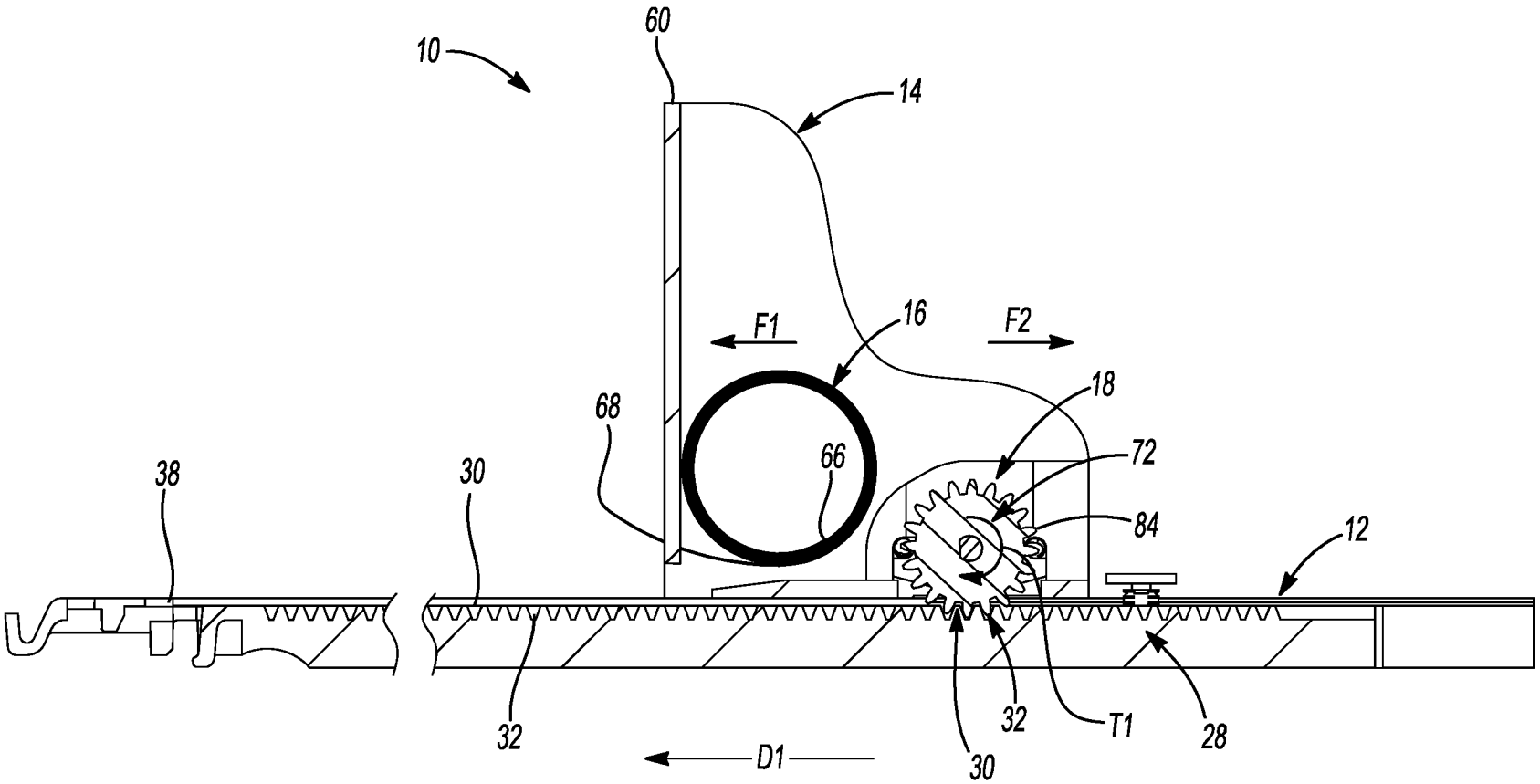
FIG. 5 is a cross-sectional view of the dispensing system of FIG. 1, taken through the line 5-5 of FIG. 4.

As illustrated in FIG. 1, the first engagement mechanism 28 may include a gear rack 29 having a plurality of teeth 30 and/or detents 32 disposed along the length of the track 12 in the first direction D1. For example, as shown in FIG. 5, the gear rack 29 may include a series of alternating teeth 30 and detents 32. While the illustrated example shows the teeth 30 of the gear rack 29 formed substantially flush with a top surface of the first engagement mechanism 28, in other examples the teeth 30 may protrude from the top surface of the first engagement mechanism 28.

With continued reference to FIG. 1, in some configurations, the mounting head 20 is disposed at the front end 34 of the track 12. In some examples, the mounting head 20 may include a top face 36 having an aperture 38, a front face 40 extending from the top face 36, and a front lip 42 extending from the front face 40. In some implementations, the front lip 42 is configured to engage the rail of the shelf or other suitable supporting device (not shown).

With continued reference to FIG. 1, in some implementations, the pair of opposed rails 24, 26 may extend beyond the first engagement mechanism 28 at the rear end 44 of the track 12, thereby defining a opening 46 extending between the opposed rails 24, 26 at the rear end 44. In some configurations, the opening 46 may permit the rear end 44 of the track 12 to be flexible in relation to the remainder of the track 12. However, in use, the opening 46 works in conjunction with the barbs 55 of the legs 54 to allow the pusher 14 to be coupled to the track 12 by snapping the pusher 14 onto the track 12 from above. Namely, the opening 46 provides a space for receiving a portion of the damper system 18 when the pusher 14 is engaged with the track 12.

Figure 2:
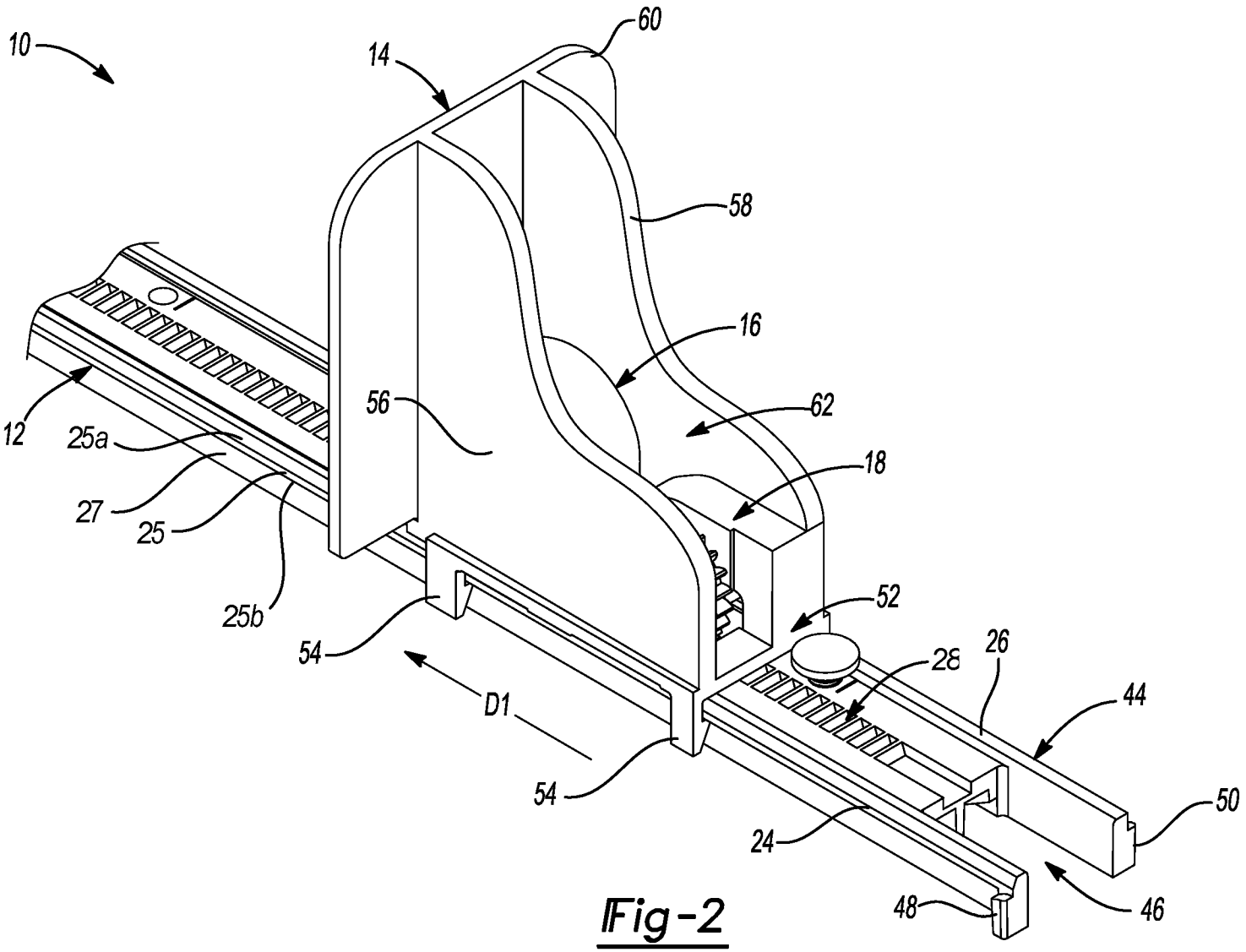
FIG. 2 is a rear perspective view of the dispensing system of FIG. 1.

As illustrated in FIG. 2, a pair of stops 48, 50 may be disposed proximate the rear end 44 of track 12. As shown, each of the stops 48, 50 extends outwardly from a respective one of the opposed rails 24, 26 at the rear end 44 of each of the channels 27. The pair of opposing stops 48, 50 may extend in opposite directions from each other and away from, and be spaced apart by, the opening 46. In some examples, a top end of each stop 48, 50 is offset or recessed from the top surface of the respective rail 24, 26, such that the top of the stop 48, 50 is positioned below the pair of opposed rails 24, 26.

Referring to FIG. 2, in some configurations, the pusher 14 may include a base 52, a plurality of engagement legs 54, a pair of opposing side walls 56, 58, and a paddle 60. In an assembled configuration, the pusher 14 is mounted to the track 12 and is configured to move along the track 12 in the first direction D1. In particular, the pusher 14 is configured to move merchandise (not shown) along the track 12 in the first direction D1.

In some implementations, the plurality of engagement legs 54 may extend from and below the base 52 of the pusher 14. The engagement legs 54 may be configured to engage, and removably secure the pusher 14 to, the side rails 24, 26 of the track 12. While the pusher 14 is shown having four engagement legs 54, it will be appreciated that the pusher 14 may include more or less than four engagement legs 54 within the scope of the present disclosure. In the illustrated example, the engagement legs 54 cooperate to define a slot or groove 57 configured to receive the flanges 25 of each track 24, 26 to provide a sliding interface between the pusher 14 and the rail 12.

Figure 3:
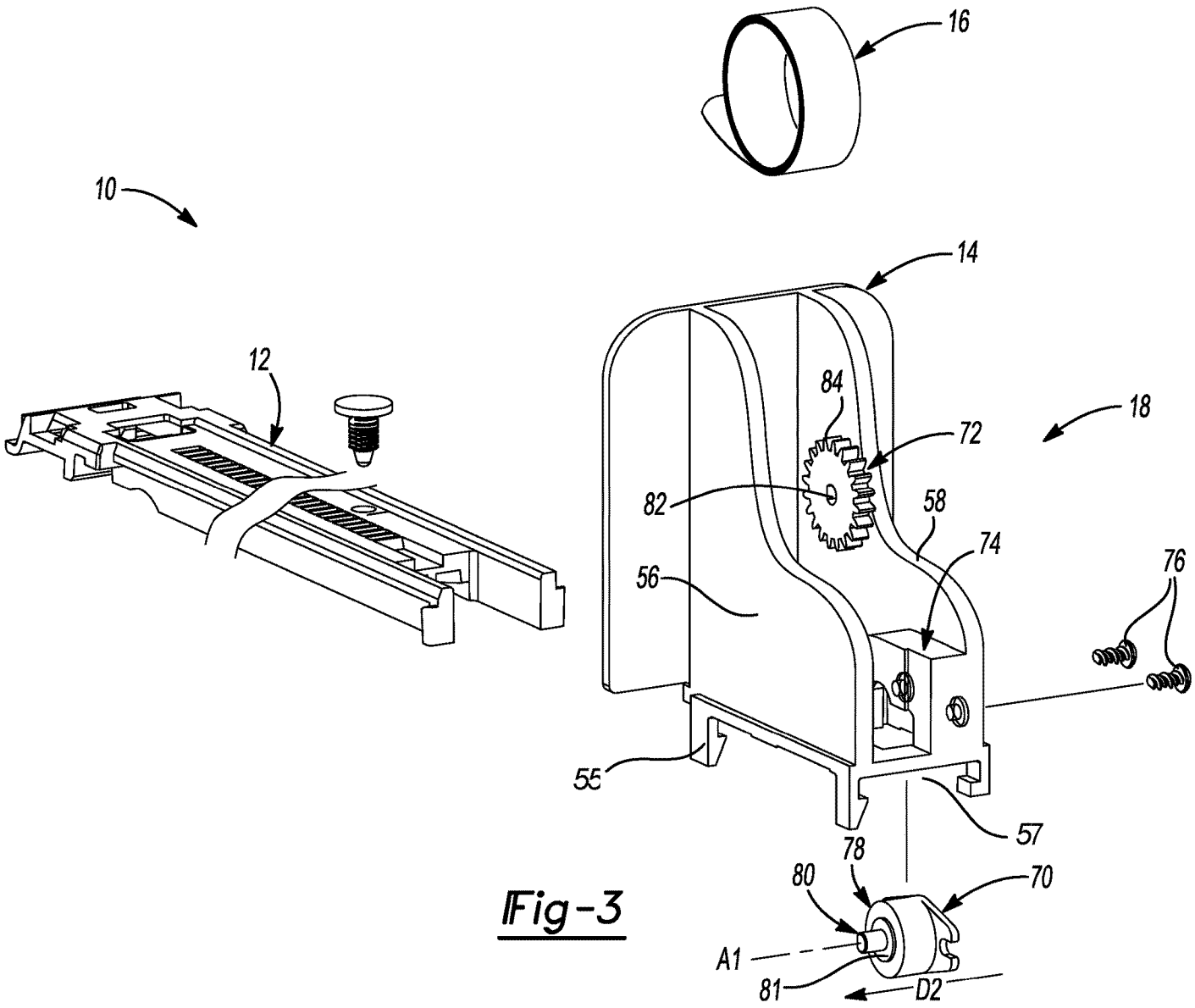
FIG. 3 is an exploded view of the dispensing system of FIG. 1.

As best shown in FIG. 3, the legs may include one or more legs 54 configured to engage the flange 25 of the first rail 24 and one or more legs configured to engage the flange 26 of the second rail 24. At least one of the legs 24 may include a barb 55 formed adjacent to a distal end of the leg 54. The barb 55 includes a lower surface oriented at an oblique angle and an upper locking surface oriented at a substantially horizontal angle. The lower surface of the barb 55 is configured to engage the upper biasing surface 25*a* of one of the flanges 25 when the pusher 14 is lowered onto the track 12. The respective angles of the upper biasing surface 25*a* and the lower surface of each barb 55 causes each barb 55 to be biased outwardly as it slides over the flange 25. Once the upper locking surface of each barb 55 is clear of the lower locking surface 25*b* of the flange 25, the barb 55 will return to its natural, unbiased position so that the upper locking surface of the barb 55 is disposed within the channel 27 and engages the lower locking surface 25*b* of the flange 25. In simpler terms, the barbs 55 of the pusher 14 are configured to snap into the channels 27 to slidingly secure the pusher 14 to the track 12.

Figure 4:
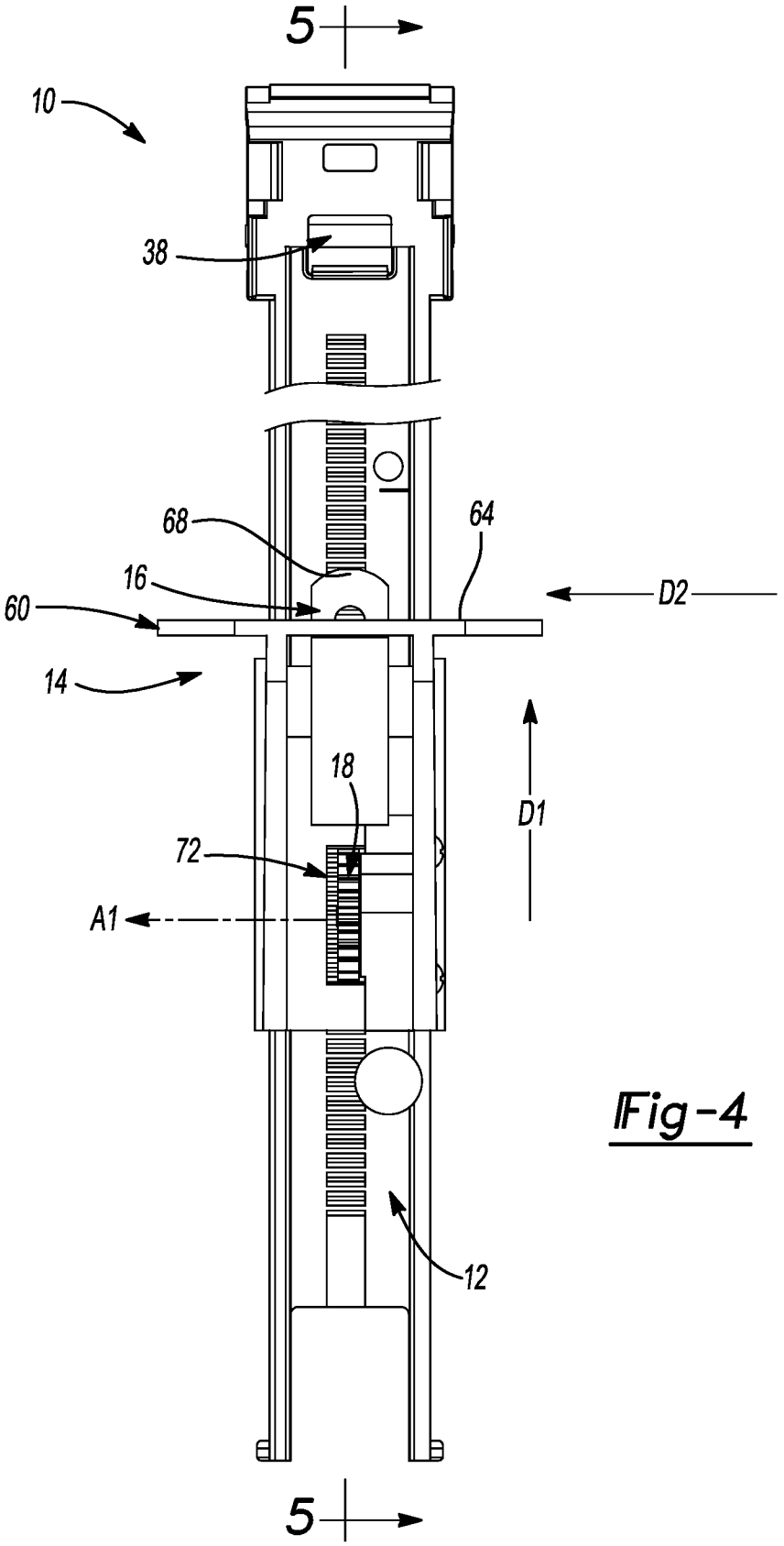
FIG. 4 is a top view of the dispensing system of FIG. 1.

With further reference to FIG. 2, in some examples, the opposing side walls 56, 58 of the pusher 14 may extend from and above the base 52. The opposing side walls 56, 58 may be spaced apart from one another, thereby defining a void 62 between the side walls 56, 58. As illustrated in FIG. 2, the paddle 60 may be coupled to the base 52 and the side walls 56, 58. As illustrated in FIGS. 1 and 4, the paddle 60 may include a front face 64 that extends in a second direction D2 that is orthogonal to the first direction D1. During operation of the dispensing system 10, the front face 64 is configured to engage the merchandise.

With reference to FIGS. 1, 4 and 5, in some implementations, the biasing member 16 includes a coil spring having a proximal end 66 and a distal end 68. In the assembled configuration, the biasing member 16 engages the pusher 14 and the track 12. As illustrated in FIG. 2, the biasing member 16 may be disposed within the void 62 of the pusher 14. The biasing member 16 may be configured to apply a force F1 to the pusher 14 and the track 12 to urge the pusher 14 in the first direction D1 relative to the track 12. As illustrated in FIG. 1, in the assembled configuration, a portion of the biasing member 16 may extend along the track 12, whereby the distal end 68 of the biasing member 16 is secured to the mounting head 20 of the track 12. In particular, a portion of the distal end 68 may be disposed within the aperture 38 of the mounting head 20. In some configurations, the dispensing system 10 may include an adjustment mechanism (not shown), by which a user can vary the spring constant of, and thus the force (e.g., F1) applied by, the biasing member 16. In addition, or alternatively, during operation of the dispensing system 10, the user may replace the biasing member 16 having a first spring constant with another biasing member (not shown) having a second constant that is different (e.g., greater than or less than) the first spring constant.

During operation of the dispensing system 10, the biasing member 16 urges the pusher 14 in the first direction D1, and the merchandise (not illustrated) is placed on top of the portion of the biasing member 16 that extends along the track 12. In some implementations, the biasing member 16 is made from a conventional metal, which is inherently more slippery than the material of the track 12. Accordingly, the metal biasing member 16 allows the merchandise to slide more easily in the first direction D1 than if the merchandise was placed directly onto the track 12.

With reference to FIG. 3, in some implementations, the damper system 18 may include a damper 70, a pinion gear 72, and a base 74. As illustrated in FIG. 2, the damper system 18 may be disposed within the void 62 of the pusher 14, adjacent to the biasing member 16. As illustrated in FIG. 3, the base 74 of the damper system 18 may be formed in or attached to one of the opposing side walls 56, 58 of the pusher 14. For example, the base 74 is depicted in FIG. 3 as being integrated with the side wall 58 of the pusher 14. In some configurations, the base 74 of the damper system 18 may be detachably coupled to one of the opposing side walls 56, 58 of the pusher 14.

With reference to FIGS. 3 and 5, in some implementations, the damper 70 is detachably coupled to the base 74. In particular, the damper 70 may be attached to the base 74 via screws 76. It will be appreciated that any other suitable attachment mechanism may be implemented within the scope of the present disclosure (e.g., adhesives, snap-fit, etc.).

With continued reference to FIG. 3, in some configurations, the damper 70 of the damper system 18 may include a body 78 and a shaft 80. As depicted in FIG. 3, the body 78 of the damper 70 is shown having a cylindrical shape. It will be appreciated that the body 78 may encompass any other suitable shape (e.g., rectangular, etc.) within the scope of the current disclosure. As illustrated in FIG. 3, the body 78 may include a damper mechanism 81, such as a viscous damper mechanism (e.g., a rotary dashpot), a friction damper mechanism, a magnetic damper mechanism, or tuned mass damper mechanism. The damper mechanism 81 may be rotatably coupled to the shaft 80 such that rotation of the shaft 80 about a first axis A1 is resisted by the damper mechanism 81.

As illustrated in FIG. 3, the shaft 80 of the damper 70 may extend from the body 78 in the second direction D2. During operation of the damper system 18, the shaft 80 rotates about the first axis A1. With continued reference to FIG. 3, the pinion gear 72 of the damper system 18 may be referred to as a second engagement mechanism and includes a centrally located aperture 82 and a plurality of teeth 84 disposed about the perimeter of the pinion gear 72. In the assembled configuration, the pinion gear 72 is coupled to the shaft 80 of the damper 70. In particular, the aperture 82 of the pinion gear 72 includes a shape that corresponds to the shape of the shaft 80. During operation of the damper system 18, pinion gear 72 rotates with the shaft 80 of the damper 70 about the first axis A1.

As illustrated in FIG. 5, in the assembled configuration, the teeth 84 of the pinion gear 72 are aligned with (e.g., meshed with) the teeth 30 and detents 32 of the gear rack 28 of the track 12. In particular, the teeth 84 of the gear 72 are configured to engage the teeth 30 and detents 32 of the engagement mechanism 28 of the track 12. Thus, as the pusher 14 moves along the first direction from the front end 34 to the rear end 44 of the track 12, engagement of the teeth 84 of the pinion gear 72 and the teeth 30 of the gear rack 28 converts the translational movement of the pusher 14 along the first direction D1 into rotational movement of the pinion gear 72 about the first axis A1.

As previously discussed, the pusher 14 may be slidingly coupled to the track 12 by snapping the pusher 14 onto the track 12 from the top side of the track 12. Here, the pusher 14 is aligned above the track 12 such that the gear 72 of the damper system 18 is positioned above the opening 46 at the rear end 44 of the track 12. A first pair of the engagement legs 54 on a first side of the damper 18 are inserted into a corresponding channel 27 (i.e., beneath the flange 25) on one of the first rail 24 or the second rail 26. With the first pair of the engagement legs 54 received within one of the channels 27, the second pair of the engagement legs 54 including the barbs 55 are pressed upon the upper biasing surface 25*a* of the flange 25 of the other one of the rails 24, 26 so bias the second pair of legs 54 over the flange 25 and into the channel 27. As the pusher 14 is snapped onto the track 12, the gear 72 is received within the opening 46. Thus, the opening 46 allows full engagement of the pusher 14 with the track 12 without risking binding contact between the pinion gear 72 and the gear rack 29. The pusher 14 can then be moved towards the front end 34 to engage the teeth 84 of the pinion gear 72 with the teeth 30 of the gear rack 29.

During operation of the dispensing system 10, the damper system 18 is configured resist the force F1 of the biasing member 16 on the pusher 14. In particular, as illustrated in FIG. 5, the damper mechanism 81 within the body 78 of the damper system 18 applies a resistive torque T1 on shaft 80, which, in turn applies the torque T1 on the gear 72. The torque T1 on the gear 72 generates an opposing translational force F2 on the track 12 between the teeth 30 of the track 12 and the teeth 84 of the gear 72. The force F2 opposes the force F1 generated by the biasing member 16. The force F1 generated by the biasing member 16 is stronger than and capable of overcoming the force F2 generated by the damper system 18; however, the speed at which the pusher 14 is moved in the first direction D1 by the force F1 is reduced by the force F2. In other words, the biasing member 16 is configured to bias the pusher 14 towards the front end 34 of the track 12 and the damper system 18 is configured to retard movement of the pusher towards the front end 34.

For example, while in operation, the dispensing system 10 may include a plurality of items of merchandise (not shown). When an item of merchandise is removed from the dispensing system 10, the interaction of the damper system 18 with the track 12 will result in the pusher 14 moving the remaining units of merchandise at a reduced rate of speed in the first direction D1 toward the front end 34 of the track 12, thereby reducing the risk that the merchandise will be damaged while moving along the track 12.

The following Clauses provide an exemplary configuration for a dispensing system, as described above.

Clause 1: A dispensing system including a track; a pusher moveably coupled to the track; a biasing member coupled to the pusher and the track and configured to move the pusher relative to the track in a first direction; and a damper coupled to the pusher and the track and configured to reduce a speed at which the pusher moves relative to the track in the first direction.

Clause 2: The dispensing system of Clause 1, wherein the damper includes a rotary damper mechanism and a gear coupled to the rotary damper mechanism, and wherein the gear includes a first plurality of teeth configured to engage the track.

Clause 3: The dispensing system of Clause 2, wherein the track includes a second plurality of teeth intermeshed with the first plurality of teeth of the gear.

Clause 4: The dispensing system of Clause 2, wherein the pusher includes a first sidewall and a second sidewall opposing the first sidewall, the first sidewall and the second sidewall defining a void, and wherein the biasing member and the damper are at least partially disposed within the void.

Clause 5: The dispensing system of Clause 4, wherein the damper includes a body and a shaft, the body coupled to the first sidewall, the shaft coupled to the rotary damper mechanism and the gear.

Clause 6: The dispensing system of Clause 5, wherein the pusher includes a base integrally formed with the first sidewall, and wherein the body is at least partially disposed within the base.

Clause 7: The dispensing system of Clause 1, wherein the pusher includes a plurality of legs secured to the track.

Clause 8: The dispensing system of Clause 1, wherein the track includes a first rail, a second rail, and an engagement mechanism disposed between the first rail and the second rail and configured to engage the damper.

Clause 9: The dispensing system of Clause 8, wherein the damper includes a pinion gear having a first plurality of teeth, and the engagement mechanism includes a second plurality of teeth configured to engage the first plurality of teeth.

Clause 10: The dispensing system of Clause 1, further comprising an adjustment mechanism configured to change a spring constant of the biasing member.

Clause 11: A dispensing system including a rail extending from a first end to a second end and including a first engagement mechanism; and a pusher operable to move between the first end and the second end and including a biasing member configured to bias the pusher towards the first end and a second engagement mechanism configured to retard movement of the pusher towards the first end.

Clause 12: The dispensing system of Clause 11, wherein the biasing member includes a coil spring including a first end attached to the pusher and a second end attached to the rail.

Clause 13: The dispensing system of Clause 11, wherein the first engagement mechanism extends between the first end and the second end and the second engagement mechanism is engaged with the first engagement mechanism.

Clause 14: The dispensing system of Clause 13, wherein the first engagement mechanism includes an elongate engagement mechanism and the second engagement mechanism includes a rotary engagement mechanism interfacing with the first engagement mechanism.

Clause 15: The dispensing system of Clause 11, wherein the first engagement mechanism includes a gear rack and the second engagement mechanism includes a pinion gear.

Clause 16: The dispensing system of Clause 15, wherein the second engagement mechanism includes a rotary damper coupled to the pinion gear.

Clause 17: The dispensing system of Clause 16, wherein the rotary damper generates a resistive torque in response to movement of the pusher towards the first end.

Clause 18: The dispensing system of Clause 11, wherein the second engagement mechanism is disposed within a void of the pusher.

Clause 19: The dispensing system of Clause 11, wherein the rail includes a first track and a second track spaced apart from the first track by the first engagement mechanism.

Clause 20: The dispensing system of Clause 19, wherein the first track and the second track extend beyond the first engagement mechanism at the second end.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A dispensing system comprising:

a track;

a pusher moveably coupled to the track and including (i) a paddle; (ii) an opposing pair of sidewalls extending from the paddle and spaced apart from each other by a void; and (iii) a base integrally formed with a first one of the sidewalls;

a biasing member coupled to the pusher and the track and configured to move the pusher relative to the track in a first direction; and a damper coupled to the pusher and the track and configured to reduce a speed at which the pusher moves relative to the track in the first direction, the damper including (i) a body including a rotary damper mechanism coupled to the first one of the sidewalls and at least partially disposed within the base and (ii) a shaft coupled to the rotary damper mechanism; and (iii) a gear coupled to the shaft and disposed within the void between the opposing pair of sidewalls.

2. The dispensing system of claim 1, wherein the gear includes a first plurality of teeth configured to engage the track.

3. The dispensing system of claim 2, wherein the track includes a second plurality of teeth intermeshed with the first plurality of teeth of the gear.

4. The dispensing system of claim 1, wherein the pusher includes a plurality of legs secured to the track.

5. The dispensing system of claim 1, wherein the track includes a first rail, a second rail, and an engagement mechanism disposed between the first rail and the second rail and configured to engage the damper.

6. The dispensing system of claim 5, wherein the gear is a pinion gear having a first plurality of teeth, and the engagement mechanism includes a second plurality of teeth configured to engage the first plurality of teeth.

7. The dispensing system of claim 1, further comprising an adjustment mechanism configured to change a spring constant of the biasing member.

8. A dispensing system comprising:

a rail extending from a first end to a second end and including a first engagement mechanism; and a pusher operable to move between the first end and the second end and including (i) a paddle, (ii) a first sidewall and an opposing second sidewall extending from the paddle and spaced apart from each other by a void, (iii) a base integrally formed with the first sidewall, (iv) a biasing member configured to bias the pusher towards the first end and (v) a second engagement mechanism configured to retard movement of the pusher towards the first end, the second engagement mechanism including (a) a body having a rotary damper mechanism coupled to the first sidewall and at least partially disposed within the base, (b) a shaft coupled to the rotary damper mechanism, and (c) gear coupled to the shaft and disposed within the void between the first sidewall and the second sidewall.

9. The dispensing system of claim 8, wherein the biasing member includes a coil spring including a first end attached to the pusher and a second end attached to the rail.

10. The dispensing system of claim 8, wherein the first engagement mechanism extends between the first end and the second end and the second engagement mechanism is engaged with the first engagement mechanism.

11. The dispensing system of claim 10, wherein the first engagement mechanism includes an elongate engagement mechanism and the second engagement mechanism includes the gear interfacing with the first engagement mechanism.

12. The dispensing system of claim 8, wherein the first engagement mechanism includes a gear rack and the gear is a pinion gear.

13. The dispensing system of claim 12, wherein the second engagement mechanism includes the rotary damper mechanism coupled to the pinion gear.

14. The dispensing system of claim 13, wherein the rotary damper mechanism generates a resistive torque in response to movement of the pusher towards the first end.

15. The dispensing system of claim 8, wherein the rail includes a first track and a second track spaced apart from the first track by the first engagement mechanism.

16. The dispensing system of claim 15, wherein the first track and the second track define an opening configured to receive a portion of the second engagement mechanism.

* * * * *